US009759009B2

(12) United States Patent
Lin

(10) Patent No.: US 9,759,009 B2
(45) Date of Patent: Sep. 12, 2017

(54) WINDOW COVERING

(75) Inventor: Tzong-Fu Lin, Taipei (TW)

(73) Assignee: Whole Space Industries LTD, Taipei (TW)

( * ) Notice: Subject to any disclaimer, the term of this patent is extended or adjusted under 35 U.S.C. 154(b) by 1857 days.

(21) Appl. No.: 12/720,050

(22) Filed: Mar. 9, 2010

(65) Prior Publication Data

US 2011/0220301 A1 Sep. 15, 2011

(51) Int. Cl.
*E06B 9/262* (2006.01)

(52) U.S. Cl.
CPC ..... *E06B 9/262* (2013.01); *E06B 2009/2625* (2013.01)

(58) Field of Classification Search
CPC ..... E06B 9/262; E06B 2009/2625; E06B 2009/2622
USPC ..... 160/84.01, 170, 171, 264, 84.03, 84.04
See application file for complete search history.

(56) References Cited

U.S. PATENT DOCUMENTS 1,321,800 A 11/1919 Andress et al.
4,765,388 A * 8/1988 Dohlemann ..... E06B 9/262 160/348
4,909,298 A 3/1990 Langhart et al.
5,090,466 A * 2/1992 Hong ..... 160/84.04
5,123,475 A * 6/1992 Klotz ..... A47H 13/16 160/345
5,417,462 A * 5/1995 Hensley ..... A01G 1/12 141/391
5,533,559 A 7/1996 Judkins
5,566,734 A * 10/1996 Levy ..... E06B 9/262 160/121.1
5,566,735 A 10/1996 Jelic
5,630,458 A 5/1997 Holden
5,738,159 A * 4/1998 O'Brien ..... A47H 23/04 160/124

(Continued)

FOREIGN PATENT DOCUMENTS

DE 20109240 U1 8/2001
FR 2598902 A1 11/1987
WO 2010021841 A1 2/2010

OTHER PUBLICATIONS

International Search Report for PCT/US09/52802 dated Sep. 17, 2009.
European Search Report for EP 11 16 2783 dated Aug. 4, 2011.

*Primary Examiner* — Katherine Mitchell
*Assistant Examiner* — Jeremy Ramsey
(74) *Attorney, Agent, or Firm* — Buchanan Ingersoll & Rooney PC

(57) ABSTRACT

A window covering includes a first rail; window covering material, a liner, a first lift cord, and a second lift cord. The liner is positioned adjacent to the rear side of the window covering material and is moveable from a retracted position to an extended position. The liner has at least one pocket. Each pocket defines a channel within the liner. The first and second lift cords extend from the first rail to a position adjacent to a bottom edge of the window covering material. Each lift cord extends through a channel defined by a pocket of the one or more pockets. The window covering may be a Roman shade or other window covering, such as a top down bottom up shade. Preferably, the liner covers the lift cords such that no portion of a lift cord is exposed sufficiently for a child to become entangled within any of the lift cords.

22 Claims, 4 Drawing Sheets

(56) References Cited

U.S. PATENT DOCUMENTS

| | | | | |
|---|---|---|---|---|
| 5,862,850 | A * | 1/1999 | Yang | 160/84.04 |
| 6,484,787 | B1 | 11/2002 | Walters | |
| 6,637,493 | B1 | 10/2003 | Lampers | |
| 6,662,845 | B1 * | 12/2003 | Palmer | 160/84.01 |
| 6,817,399 | B2 | 11/2004 | Berman et al. | |
| 6,860,312 | B2 | 3/2005 | Judkins | |
| 6,918,425 | B2 | 7/2005 | Nien | |
| 6,948,546 | B2 | 9/2005 | Nien | |
| 7,000,672 | B2 | 2/2006 | Nien | |
| 7,086,446 | B2 | 8/2006 | Kollman et al. | |
| 7,117,918 | B2 | 10/2006 | Franssen | |
| 7,225,850 | B2 | 6/2007 | McCarty et al. | |
| 7,261,138 | B2 | 8/2007 | Judkins et al. | |
| 7,318,251 | B2 | 1/2008 | Lin | |
| 7,654,299 | B2 * | 2/2010 | LeBlanc et al. | 160/84.01 |
| 7,975,747 | B2 * | 7/2011 | Liang et al. | 160/84.04 |
| 9,382,753 | B2 * | 7/2016 | Lin | E06B 9/262 |
| 2003/0116287 | A1 | 6/2003 | Titus et al. | |
| 2004/0089428 | A1 | 5/2004 | Judkins | |
| 2004/0231804 | A1 | 11/2004 | Ward et al. | |
| 2005/0092448 | A1 * | 5/2005 | Lin | E06B 9/262 160/291 |
| 2006/0000499 | A1 * | 1/2006 | Livacich | E04H 15/001 135/90 |
| 2006/0060308 | A1 | 3/2006 | LeBlanc et al. | |
| 2006/0144526 | A1 | 7/2006 | McGinley | |
| 2006/0157204 | A1 | 7/2006 | Lin | |
| 2007/0023149 | A1 | 2/2007 | Lamars et al. | |
| 2007/0175593 | A1 | 8/2007 | Lin | |
| 2008/0110581 | A1 | 5/2008 | Lin | |
| 2008/0277074 | A1 | 11/2008 | Lin | |
| 2008/0295975 | A1 | 12/2008 | Lin | |
| 2010/0186903 | A1 | 7/2010 | Liang et al. | |
| 2010/0252209 | A1 | 10/2010 | Wang | |
| 2011/0088852 | A1 * | 4/2011 | Hu | E06B 9/262 160/84.05 |
| 2011/0132555 | A1 * | 6/2011 | Rowley | E06B 9/326 160/340 |
| 2012/0241101 | A1 * | 9/2012 | Lin | E06B 9/262 160/19 |

* cited by examiner

WINDOW COVERING

FIELD OF INVENTION

The present invention relates to window coverings such as Roman shades.

BACKGROUND OF THE INVENTION

One popular type of window covering is known as a Roman shade which may also be called a Roman blind, an Austrian shade, a Balloon Shade, or a Soft Shade. This type of shade consists of a panel or sheet of material attached along its top edge to a headrail and gathered at spaced intervals to provide a series of soft folds across the face of the fabric. Consequently, the typical Roman shade has a cascaded or softly pleated appearance. Such Roman shades are constructed so that when they are raised from an extended position, they gather from the bottom in generally horizontal folds or pleats until the entire shade resides near the top of the window covering in a retracted position. In some versions, the top of the window covering may also be lowered. The shades are operated by pulling on various lift cords which are used in conjunction with guides attached to the shade.

Most prior art Roman shades are formed either of a sheet of a flexible material such as a fabric or film or of a plurality of segments of material connected together. The material or interconnected segments are typically provided with a plurality of horizontal folds at points vertically spaced from one another to form folds when the shade is raised. A common method for making a Roman shade is to sew at least two sets of rings or connectors along vertical lines down the back of the fabric material as is shown in U.S. Pat. No. 1,321,800. The spacing of the rings or connectors affects the aesthetic effect of the shade and how the window covering material may look when being raised or lowered. Lift cords pass through the rings and each lift cord is attached to a bottom rail or the lowermost fold. Opposite ends of the lift cords are wound on a spool or shaft in the headrail. The spool or shaft may be turned by a cord loop device or a spring motor to raise and lower the shade. Alternatively, the lift cords may pass through a cord lock and be moved by a user to turn the spool or shaft.

The shade may also include spacer cords that pass through the rings. The spacer cords are typically attached to the headrail of the shade and the rings and are configured to help improve the aesthetic effect of the shade when the window covering material is raised or lowered. A liner may also be included in such shades. Roman shades may also have other configurations, such as the configurations disclosed in U.S. Pat. No. 6,662,845 and U.S. Patent Application Publication Nos. 2008/0295975, 2008/0277074, 2007/0175593, 2006/0060308 and 2006/0157204.

Roman shades may be fabricated by fabricators to make a Roman shade in a custom size to fit a customer's window opening. Fabricators may mistakenly measure or determine the necessary length of the window covering material of a Roman shade or the desired positioning of the rings on the back of the window covering material. For instance, a fabricator may want to adjust the position of the rings to achieve a different aesthetic effect for the raising and lowering of window covering material after reviewing the look provided by the initial positioning of the rings. Since rings are often sewn or affixed to the window covering material, such repositioning can be difficult and time consuming. Alternatively, Roman shades may include fastening mechanisms that permit fabricators to more easily adjust the position of the window covering material relative to the lift cords to which the window covering is attached. Examples of such devices are disclosed in U.S. Pat. Nos. 6,817,399 and 5,566,735.

On occasion, children have been able to get behind a lowered Roman shade and become entangled in one of the lift cords. If the lift cord is around the child's neck and the child falls, the cord could act as a noose and strangle the child. Indeed, reports of such incidents have prompted a major retailer to issue a recall of one product line of Roman shades and the United States Consumer Product Safety Commission has issued a warning about the danger of child entanglement and hanging from the cords in Roman shades.

There have also been incidents of child entanglements in lift cords of venetian blinds and other types of window coverings. As a result, the art has developed various types of child safety devices that are intended to prevent deaths of children who become entangled in lift cords. For instance, U.S. Pat. Nos. 7,318,251, 7,261,138, 7,225,850, 7,117,918, 7,086,446, 7,000,672, 6,948,546, 6,918,425, 6,860,312, 6,637,493, 6,484,787, 6,431,248, 5,630,458, 5,533,559 and 4,909,298 and U.S. Patent Application Publication Nos. 2008/0110581, 2007/0023149 and 2006/0144526 disclose child safety devices for blinds. Child safety devices may be configured to keep the lift cords taught so that the cords cannot be pulled away from the window covering material and form a noose or release the cord from the shade when a child becomes entangled in the shade. Most, if not all of the cord release devices are not well suited for use on Roman shades. Moreover, many conventional child safety devices for window coverings are visible from the front of the shade and detract from the aesthetic effect of the shade.

A new safety device is needed for Roman shades. Preferably, such a device can prevent the lift cords of a shade from coming into contact with a small child. Moreover, such a safety device preferably does not detract from the aesthetic effect provided by the Roman shade.

SUMMARY OF THE INVENTION

A window covering may include a first rail, window covering material positioned adjacent to the first rail, a liner positioned adjacent to the rear side of the window covering material, and a plurality of lift cords that extend from the first rail. The plurality of lift cords may include a first lift cord, and a second lift cord. The window covering material is moveable from a retracted position to an extended position and has a rear side and a front side. A liner is positioned adjacent to the rear side of the window covering material. The liner is moveable from a retracted position to an extended position. The liner has at least one pocket. Each pocket defines a channel within the liner. The first lift cord extends from the first rail to a position adjacent to a bottom edge of the window covering material. A portion of the first lift cord extends through the channel of at least one pocket. A portion of the second lift cord also extends from the first rail to the bottom edge of the window covering material. A portion of the second lift cord also extends through the channel of at least one pocket.

Embodiments of the window covering may include a Roman shade or other shade or blind. The window covering may also include a cord lock or other lift cord control mechanism configured to control movement of the lift cords. The cord lock or lift cord control mechanism may be attached to the first rail.

A portion of the first lift cord and a portion of the second lift cord may pass through a cord lock attached to the first rail in some embodiments of the window covering. The first rail may be a headrail or an intermediate rail of a top down bottom up shade.

The liner may be comprised of fabric interconnected fabric segments, mesh, interconnected mesh segments, a film or other materials. The window covering material may be comprised of fabric, woven wood, woven grass, mesh, bamboo, or other materials.

In some embodiments of the window covering, the one or more pockets may include a first pocket and a second pocket. The portion of the first lift cord may extend through the channel of the first pocket and the portion of the second lift cord may extend through the channel of the second pocket.

Each pocket may be configured so that its channel extends in a direction substantially perpendicular to the first rail. Preferably, each pocket is sewn into the liner. For example, opposite edges of the liner may be folded back over the liner and sewn into the liner to form the pockets. Of course, it is contemplated that the pockets may be formed in other ways as well.

Embodiments of my window covering may also include stiffening members. Stiffening members may be positioned within the window covering material, the liner, or both the liner and the window covering material. The stiffening members may be positioned in the liner so that they are substantially parallel to the first rail and substantially perpendicular to the lift cords. Stiffening members may also be positioned in the liner so that each stiffening member is between the first lift cord and the second lift cord.

A second rail may also be included in embodiments of my window covering. For instance, the second rail may be a bottom rail attached to a bottom edge of the window covering material. As another example, the second rail may be attached to an end of the first lift cord and an end of the second lift cord.

Preferably, the liner is attached to the first rail. For instance, the liner may be attached to the first rail via a fastener such as a screw, bolt, nail, Velcro® connection mechanism, an adhesive or other fastening mechanism. The top edge of the liner is preferably attached to the first rail.

An improved Roman shade of the type having a first rail, window covering material having a rear face, a top edge connected to the first rail, and a bottom edge opposite the top edge, and lift cords extending from the first rail toward the bottom edge of the window covering material is also provided. The improved Roman shade includes an improvement that includes a liner connected to the window covering material adjacent to the rear face of the window covering material. The liner has opposite edges folded back over the liner to form a pair of spaced apart pockets. Each lift cord of the lift cords passing through one of the pair of pockets.

Other details, objects, and advantages of the invention will become apparent as the following description of certain present preferred embodiments thereof and certain present preferred methods of practicing the same proceeds.

BRIEF DESCRIPTION OF THE FIGURES

Present preferred embodiments of my Roman shade are shown in the accompanying drawings and certain present preferred methods of practicing the same are also illustrated therein.

DESCRIPTION OF PRESENT PREFERRED EMBODIMENTS

Figure 1:
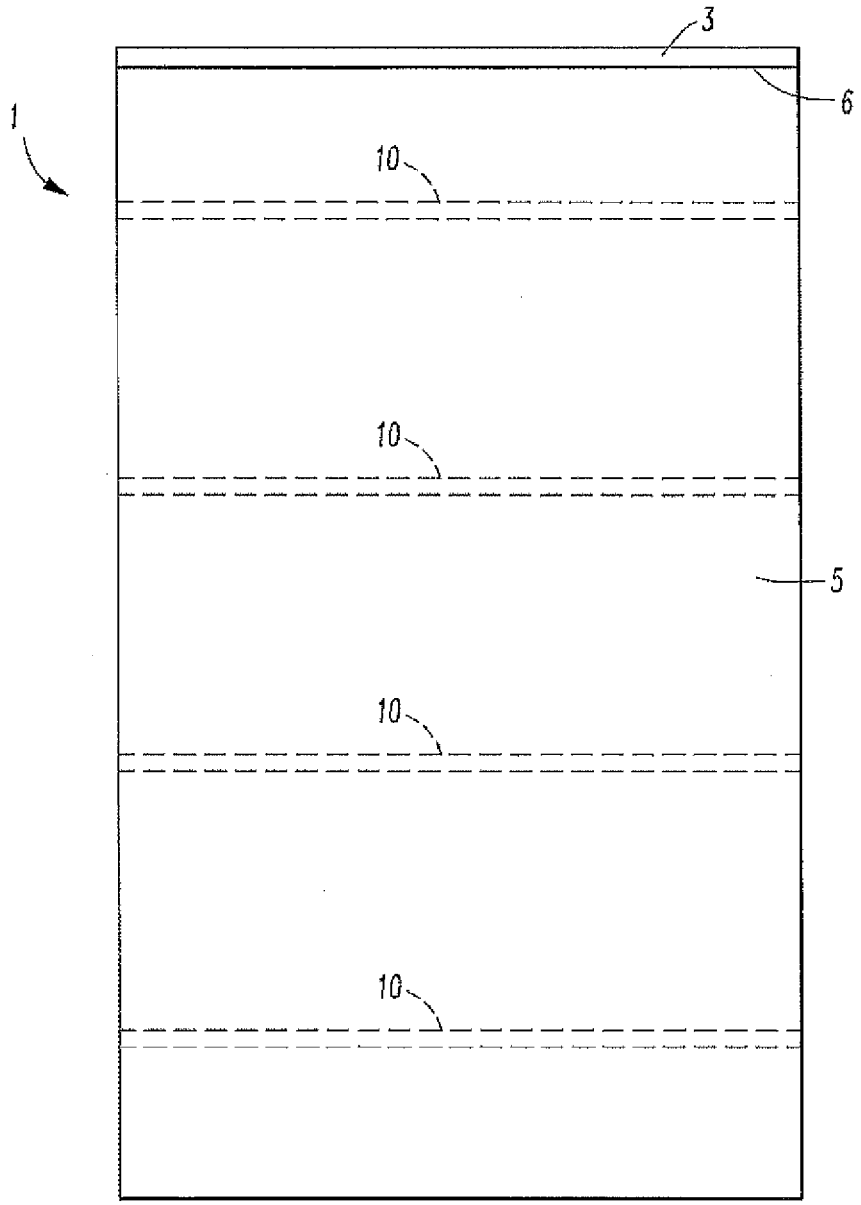
FIG. 1 is a front view of a first present preferred embodiment of the window covering in an extended position. Stiffening members that may be positioned in the window covering material are shown in dotted line.
Figure 2:
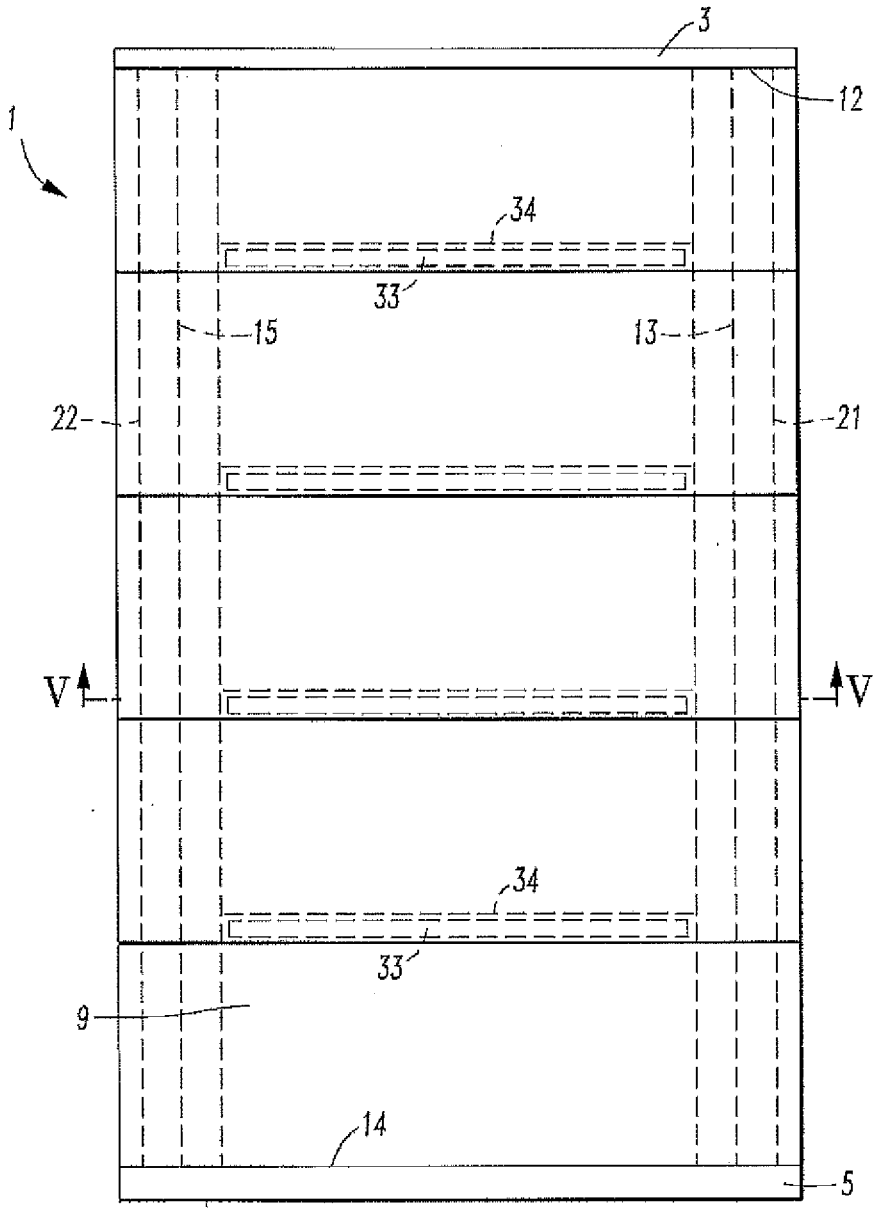
FIG. 2 is a rear view of the first present preferred embodiment of the window covering in the extended position. A portion of the lift cords in channels defined by pockets of the liner are shown in chain line.
Figure 3:
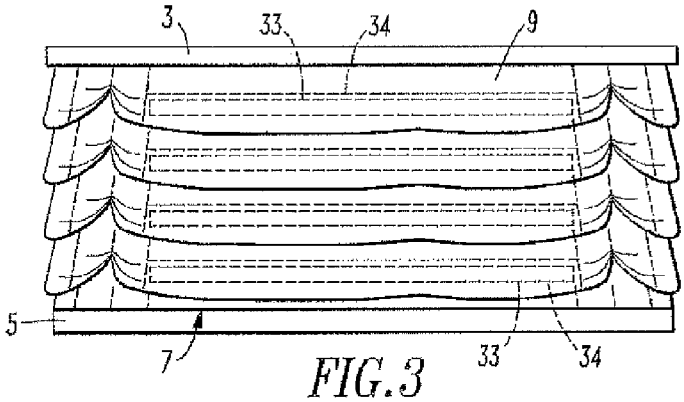
FIG. 3 is a rear view of the first present preferred embodiment of the window covering in a retracted position.
Figure 4:
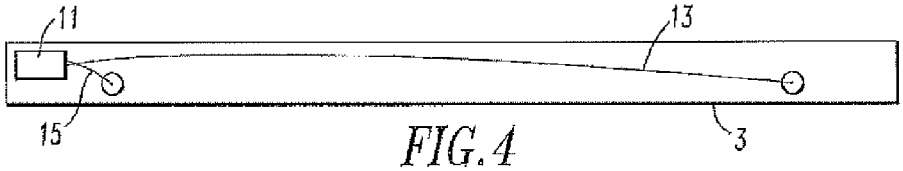
FIG. 4 is a top view of the first present preferred embodiment of the window covering.

Referring to FIGS. 1-6, a window covering 1 may include a headrail 3 and window covering material 5 positioned adjacent to the headrail. The window covering material 5 may be attached to the headrail 3 or may be otherwise positioned adjacent to the headrail so that the window covering material may be moved from an extended position to a retracted position. The window covering material may have a top edge 6 and a bottom edge 7. The window covering material may also have a front side and a rear side opposite the front side. The rear side may extend from the top edge to the bottom edge and the front side may also extend from the top edge to the bottom edge. The window covering material may be composed of numerous different types of materials. For example, the window covering material may be composed of interconnected fabric segments, fabric, woven wood, bamboo, woven grass, films, mesh material, sheer material, pleated material, or other materials.

A first lift cord 13 and a second lift cord 15 extend from the headrail 3 to adjacent the bottom edge 7 of the window covering material 5 (e.g. via liner 9 as discussed herein). A portion of the first lift cord 13 and a portion of the second lift cord 15 extend through a cord lock 11. A user may manipulate a portion of the lift cords to raise or lower the window covering material 5. For example, retraction of the window covering material may raise the window covering material. An extension of the window covering material may lower the window covering material.

As an alternative to the cord lock 11, it is contemplated that a spring motor or other lift mechanism may be used to control the movement of the first lift cord 13 and second lift cord 15 for raising and lowering the window covering material to a desired position.

In some embodiments of the window covering 1, such as Roman shade versions of the window covering 1, stiffening members 10 may be positioned within the window covering material 5. The stiffening members 10 may be positioned in horizontal pockets, may be sewn into the window covering material or may be otherwise attached to the window covering material 5. The stiffening members 10 may be rods, bars, shafts, sewn portions of the material, or other structures. The stiffening members 10 may be composed of metal, wood, or other materials. Preferably, the stiffening members 10 are positioned to stiffen certain portions of the window covering material so the window covering material 5 may form soft folds as the material is retracted towards the headrail.

A liner 9 is positioned adjacent to the headrail 3 and the rear side of the window covering material 5. The liner 9 has a top edge 12 attached to the headrail and a bottom edge 14 positioned adjacent to the bottom edge of the window covering material. It is contemplated that the bottom edge 14 of the liner 9 may be attached to the bottom edge 7 of the window covering material 5 or to a portion of the window covering material adjacent to the bottom edge 7 of the window covering material 5. Alternatively, the bottom edge of the liner 9 may not be attached to the window covering material. The liner 9 is positioned such that the liner moves when the window covering material is retracted or extended. The liner 9 may retract when the window covering material 5 retracts and may extend when the window covering material 5 extends.

The liner 9 has a first pocket 21 and a second pocket 22. The first pocket defines a channel in the liner that is sized and configured to receive a portion of the first lift cord 13. The second pocket 22 also defines a channel in the liner. The channel of the second pocket 22 is sized and configured to receive a portion of the second lift cord 15. The pockets 21 and 22 may be sewn into the liner 9 or may be otherwise formed in the liner or attached to the liner to define channels for the lift cords. For instance, opposite sides of the liner may be folded together and portions of the liner may be sewn together to form the pockets. As another example, opposite edges of the liner may be folded back over the liner and sewn to the liner to form a pair of spaced apart pockets.

The liner 9 may be sized and configured such that any portion of a lift cord that is not within or attached to the window covering material 5 or the headrail 3 is within the pockets 21 and 22. This can permit the lift cords to be completely covered and prevent children from playing with the lift cords or becoming entangled within any lift cords. As another alternative, the liner 9 may be sized and configured such that the only portion of the lift cords that is not covered by the liner is the portion that may extend from a cord lock and out of the headrail for a user to manipulate to raise or lower the window covering material.

The liner used in embodiments of the window covering may be made quite inexpensively, adding very little to the cost of the shade while still providing significant improvements in safety. The liner may be made by an inexpensive non-woven fabric, for example. The pockets can be easily and quickly formed by folded over a portion of each vertical edge of the liner and sewing that edge to the fabric using automatic seqing equipment. As another alternative, the pockets may be formed by folding material for the liner in half and forming the pockets by sewing the liner portions together at different locations to meet a particular design objective.

Figure 5:
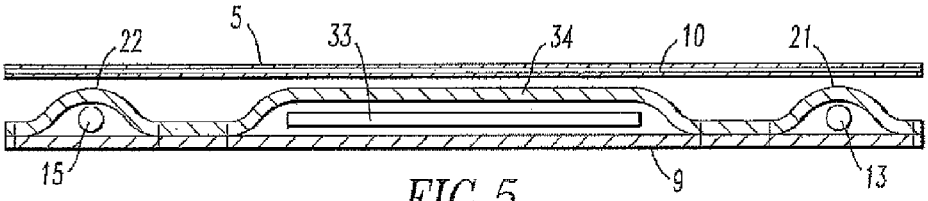
FIG. 5 is a cross sectional view of first present preferred embodiment of the window covering taken along line V-V shown in FIG. 2 illustrating lift cords positioned within channels defined by pockets of the liner. Stiffening members that may be positioned within the liner such that the members are perpendicular or substantially perpendicular to the lift cords are shown in dotted line in FIG. 5.
Figure 6:
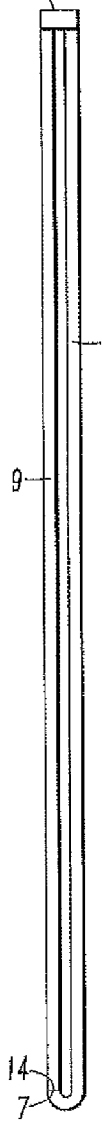
FIG. 6 is a side view of the first present preferred embodiment of the window covering.

As may be appreciated from FIG. 5, the liner 9 may also include a plurality of pockets 34 that hold, retain or support stiffening members 33, which are shown in dotted line in FIG. 5. The pockets 34 may be horizontal or substantially horizontal. The stiffening members may be bars, rods, shafts, or other structures. The stiffening members 33 are preferably positioned substantially perpendicular to the first lift cord 13 and second lift cord 15. For instance, the stiffening members may be elongated such that each member has a length that is longer than its height and its width and be aligned such that the length of each stiffening member is substantially perpendicular to the lift cords. The stiffening members 33 may also be aligned so that the length of the stiffening members are substantially parallel to the headrail 3. The stiffening members 33 may permit the liner to form soft folds, billowed portions or balloon-like portions when the liner moves while the window covering material is retracted, or raised.

The stiffening members 33 may also be substantially parallel to the headrail 3. For example, the stiffening members 33 may be perfectly parallel to the headrail 3 or perfectly perpendicular to the lift cords. As another example, the stiffening members 33 may alternatively be positioned so that they are about perpendicular or generally perpendicular to the lift cords and may alternatively be positioned so that they are about parallel or generally parallel to the headrail 3.

Figure 7:
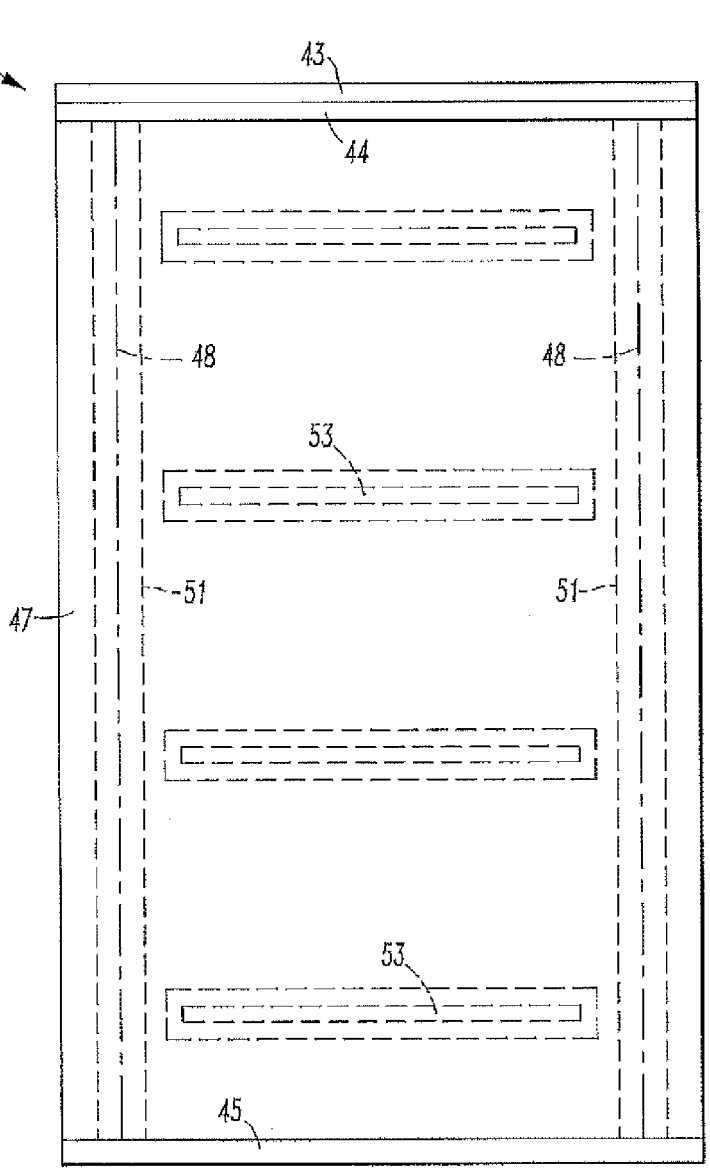
FIG. 7 is a rear view of a second present preferred embodiment of the window covering. A portion of the lift cords in channels defined by pockets of the liner are shown in chain line. The pockets formed in the liner and stiffening members positioned within the liner are shown in dotted line.

It should be understood that embodiments of my window covering my include top down bottom up shades, as may be appreciated from FIG. 7. Top down bottom up shade 41 includes a top rail 43, an intermediate rail 44 that is moveable relative to the top rail 43, and a bottom rail 45 that is moveable relative to the intermediate rail 44 and is also moveable relative to the top rail 43. Lift cords 48 may extend from the intermediate rail 44 to the bottom rail 45 or to a bottom portion of the window covering material. A liner 47 may be positioned adjacent to the rear surface of the window covering material. The liner 47 and the window covering material may be moveable such that the material can retract toward the intermediate rail 44 or extend such that the bottom rail 45 is moved farther away from the intermediate rail 44.

A portion of the lift cords 48 passes through pockets 51 formed in the liner 47. Stiffening members 53 may also be provided in the liner. The stiffening members 53 may be positioned such that the stiffening members are in an alignment that is substantially parallel to the top rail 43, intermediate rail 44 and bottom rail 45 and is substantially perpendicular to the lift cords 48. For instance, the stiffening members 53 may be aligned such that the length of each stiffening member 53 is substantially parallel to the top rail 43, intermediate rail 44, and bottom rail 45 and is substantially perpendicular to the lift cords 48.

It should be appreciated that a lift cord control mechanism for raising and lowering the window covering material may be positioned in the intermediate rail 44 or top rail 43. Of course, another set of cords and another cord control mechanism may also be provided in the top rail 43 to control movement of the intermediate rail 44 relative to the top rail 43.

It should be appreciated that other variations of the present preferred embodiments discussed above may be made. For example, the number of lift cords required for any particular Roman shade or other window covering can vary according to the size and weight of the shade material. As another example, the number of pockets provided within a liner may be adjusted to meet a particular design objective. For instance, some liners may include one pocket that defines a channel for multiple lift cords. As another example, other liners may have pockets that each define a channel for only one lift cord.

While certain present preferred embodiments of my window covering and certain embodiments of methods of practicing the same have been shown and described, it is to be distinctly understood that the invention is not limited thereto but may be otherwise variously embodied and practiced within the scope of the following claims.

I claim:

1. A window covering comprising:

a first rail;

window covering material positioned adjacent to the first rail, the window covering material moveable from a retracted position to an extended position, the window covering material having a top edge and a lower edge below the top edge, a front side and a rear side opposite the front side;

a liner positioned adjacent to the rear side of the window covering material, the liner moveable from a retracted position to an extended position, the liner having at least one pocket, the at least one pocket defining a channel in the liner; and a first lift cord extending from the first rail to a position adjacent to the lower edge of the window covering material, a portion of the first lift cord extending through the channel.

2. The window covering of claim 1 wherein the window covering is a shade.

3. The window covering of claim 1 further comprising a cord lock attached to the first rail.

4. The window covering of claim 3 wherein a portion of the first lift cord extends through the cord lock.

5. The window covering of claim 1 further comprising a lift cord control mechanism attached to the first rail, the lift cord control mechanism configured to control movement of the first lift cord.

6. The window covering of claim 1 wherein the liner is comprised of fabric, interconnected fabric segments, mesh, or interconnected mesh segments.

7. The window covering of claim 1 wherein the at least one pocket is comprised of a first pocket formed in the liner and a second pocket formed in the liner, a portion of the first lift cord extending through a first channel of the first pocket, and the window covering also comprising: a second lift cord, a portion of the second lift cord extending through a second channel of the second pocket.

8. The window covering of claim 7 further comprising a plurality of stiffening members, each stiffening member positioned within the liner such that each stiffening member is substantially perpendicular to the first and second lift cords.

9. The window covering of claim 8 wherein each stiffening member is comprised of a rod, shaft or bar and wherein each stiffening member is positioned between the first lift cord and the second lift cord.

10. The window covering of claim 8 further comprising at least one stiffening member attached to the window covering material.

11. The window covering of claim 1 further comprising a second rail, the second rail attached to the lower edge of the window covering material or the second rail attached to a portion of the first lift cord.

12. The window covering of claim 1 wherein the channel extends in a direction substantially perpendicular to the first rail and wherein each pocket is sewn into the liner.

13. The window covering of claim 1 wherein the window covering material is comprised of fabric, woven wood, woven grass, interconnected fabric segments, or bamboo.

14. The window covering of claim 1 wherein the liner is attached to the first rail.

15. The window covering of claim 14 wherein the liner has a top edge and a bottom edge opposite the top edge, and the top edge of the liner is attached to the first rail to attach the liner to the first rail.

16. A window covering comprising:

a headrail;

window covering material positioned adjacent to the headrail, the window covering material moveable from a retracted position to an extended position, the window covering material having a top edge, a lower edge opposite the top edge, a front side and a rear side opposite the front side;

a liner positioned adjacent to the rear side of the window covering material, the liner moveable from a retracted position to an extended position, the liner having a first pocket formed in the liner and a second pocket formed in the liner, the first pocket defining a first channel in the liner, the second pocket defining a second channel in the liner;

a first lift cord extending from the headrail to a position adjacent to the lower edge of the window covering material, a portion of the first lift cord extending through the first channel of the first pocket;

a second lift cord extending from the headrail to a position adjacent to the lower edge of the window covering material, a portion of the second lift cord extending through the second channel of the second pocket; and a cord lock attached to the headrail, a portion of the first lift cord extending through the cord lock and a portion of the second lift cord extending through the cord lock.

17. The window covering of claim 16 wherein the first and second pockets are sewn into the liner.

18. The window covering of claim 17 further comprising a plurality of stiffening members, each stiffening member positioned within the liner such that each stiffening member is substantially perpendicular to the first and second lift cords and each stiffening member is substantially parallel to the headrail.

19. The window covering of claim 18 wherein each stiffening member is comprised of a rod, a shaft or a bar, each stiffening member is positioned between the first lift cord and the second lift cord and each pocket is sewn into the liner.

20. An improved window covering having a first rail, window covering material having a rear face, a top edge connected to the first rail, and a bottom edge opposite the top edge, and lift cords extending from the first rail toward the bottom edge of the window covering material, wherein the improvement comprises:

a liner connected to the window covering material adjacent to the rear face of the window covering material, the liner having a pair of spaced apart pockets defined by opposite edges of the liner being folded back over the liner, each lift cord of the lift cords passing through one of the pair of pockets.

21. The improved window covering of claim 20 further comprising a plurality of stiffening members, each stiffening member positioned within the liner such that each stiffening member is substantially perpendicular to the lift cords and is substantially parallel to the first rail, and wherein the pockets each define a channel within the liner that extends from adjacent an upper edge of the liner to adjacent a bottom edge of the liner.

22. The improved window covering of claim 21 wherein each stiffening member is comprised of a rod, shaft or bar and wherein each stiffening member is positioned between a first lift cord of the lift cords and a second lift cord of the lift cords.

* * * * *